US006018971A

United States Patent [19]

Kleinschmidt

[11] Patent Number: 6,018,971

[45] Date of Patent: Feb. 1, 2000

[54] APPARATUS FOR HYDRAULICALLY SHAPING HOLLOW BODIES OF METAL

[75] Inventor: Jürgen Kleinschmidt, Beverungen, Germany

[73] Assignee: Bentler AG, Paderborn, Germany

[21] Appl. No.: 09/263,583

[22] Filed: Mar. 6, 1999

[30] Foreign Application Priority Data

Mar. 6, 1998 [DE] Germany ..... 198 09 746

[51] Int. Cl.[7] ..... B21D 26/02

[52] U.S. Cl. ..... 72/61; 72/455

[58] Field of Search ..... 72/60, 61, 62, 72/63, 455

[56] References Cited

U.S. PATENT DOCUMENTS

| | | | |
|---|---|---|---|
| 4,580,436 | 4/1986 | Nelson | 72/455 |
| 5,415,021 | 5/1995 | Folmer | 72/61 |
| 5,568,742 | 10/1996 | Bauer | 72/61 |
| 5,600,983 | 2/1997 | Rigsby | 72/61 |
| 5,711,059 | 1/1998 | Schafer | 72/61 |

FOREIGN PATENT DOCUMENTS 19607257 8/1997 Germany .

*Primary Examiner*—David Jones
*Attorney, Agent, or Firm*—Friedrich Kueffner

[57] ABSTRACT

An apparatus for hydraulically shaping hollow bodies of metal using a shaping tool arranged in a press frame includes a shaping tool arranged in a press frame, wherein the shaping tool has a lower part mounted so as to be displaceable vertically guided between an open position and a closed position and a movably supported upper part, wherein the lower part can be locked in the closed position by a locking member and the upper part can be pressed hydraulically against the lower part.

4 Claims, 2 Drawing Sheets

APPARATUS FOR HYDRAULICALLY SHAPING HOLLOW BODIES OF METAL

BACKGROUND OF THE INVENTION

1. Field of the Invention

The present invention relates to an apparatus for hydraulically shaping hollow bodies of metal using a shaping tool arranged in a press frame.

2. Description of the Related Art

In a method known in the art for hydraulically deforming metal hollow bodies, particularly tubular structural components, by means of an internal high pressure, the hollow body is placed in an initially open two-part shaping tool composed of an upper part and a lower part, the shaping tool is then closed and to at least one end of the hollow body is then secured a sealing plug through which a hydraulic internal high pressure is applied to the hollow body in order to shape the hollow body in accordance with predetermined contours in the shaping tool.

This known method predominantly uses hydraulic holding presses with a stationary lower part and a displaceable upper part. The upper part is closed and opened by means of hydraulic cylinders. The holding press is controlled in such a way that it holds the shaping tool closed for a longer period of time during the hydraulic shaping process. The cylinders must travel the entire distance in accordance with the opening stroke. This results in correspondingly long cycle periods. Since the closing force required for the internal high pressure shaping process is relatively high, it is additionally required to provide a very complicated hydraulic system.

Also known in the art are presses in which the shaping tool is locked mechanically. Due to the forces acting during the hydraulic deformation and the resulting reaction forces, the side posts of the press frame may expand longitudinally with the result that the shaping tool opens. Consequently, the hollow body is no longer held in a positively engaging manner during the deformation in the plane of separation between the lower part and the upper part; this has a disadvantageous effect on the quality of the shaped product. This means that a resetting of the shaping tool during the shaping process is required which, however, cannot be carried out or can only be carried out using a complicated construction in the presses known in the art.

SUMMARY OF THE INVENTION

Therefore, it is the primary object of the present invention to provide an apparatus for hydraulically shaping hollow bodies of metal of the above-described type which ensures with simple means a quick and precise closing process of the shaping tool with sufficiently large opening strokes and which facilitates a more economical hydraulic shaping process.

In accordance with the present invention, the apparatus for hydraulically shaping hollow bodies of metal includes a shaping tool arranged in a press frame, wherein the shaping tool has a lower part mounted so as to be displaceable vertically guided between an open position and a closed position and a movably supported upper part, wherein the lower part can be locked in the closed position by a locking member and the upper part can be pressed hydraulically against the lower part.

The locking member may be composed of a single piece or may be composed of several pieces.

For placing the hollow body to be shaped in the shaping tool, the lower part is in the open position. The locking member is also opened. After placing the hollow body in the shaping tool, the upper and lower parts are moved together. This is effected by means of a lifting table which is displaced by a hydraulic cylinder.

The lower part is moved into the closed position with the upper part and is locked in this position by the locking member. The upper part is subsequently pressed hydraulically against the lower part. The stroke carried out during this process is very small. When the internal high pressure shaping process is subsequently carried out, the shaping tool is braced between a mechanical support toward the bottom and a hydraulic support toward the top.

When any longitudinal expansion occurs in the side posts of the press frame, the hydraulically supported upper part is immediately and automatically reset. Consequently, an opening or misalignment of the shaping tool is impossible. This ensures a precise shaping process. Another advantage of the apparatus according to the present invention are the short cycle times required by the apparatus. The lifting cylinder of the lower part does not have to apply shaping or deforming forces. The closing cylinders of the upper part form a hydraulic support and only have to be reset in the case of a longitudinal expansion in the press frame. Accordingly, the hydraulic system can be constructed simpler and is less expensive.

In accordance with another feature of the present invention, the upper part is braced against the press frame through a hydraulic cushion.

In accordance with another feature, the hydraulic cushion includes at least one piston/cylinder unit. In practical use, it is best to use two piston/cylinder units.

The locking member is mounted so as to be pivotable into its locking position.

In accordance with an alternative embodiment, the locking member can be displaced by a translatory movement into its locking position.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
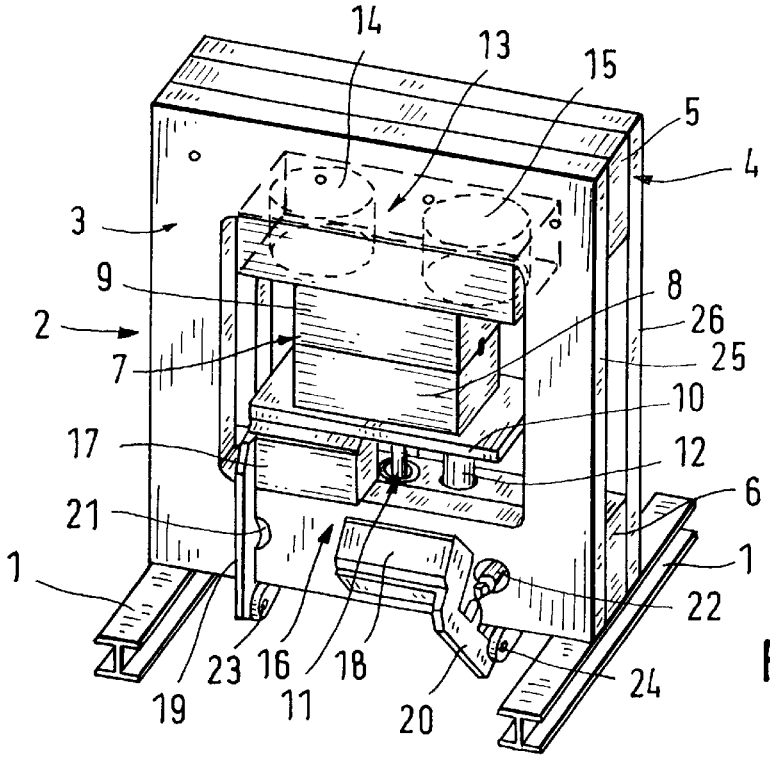
FIG. 1 is a perspective view of a first embodiment of the apparatus according to the present invention.
Figure 2:
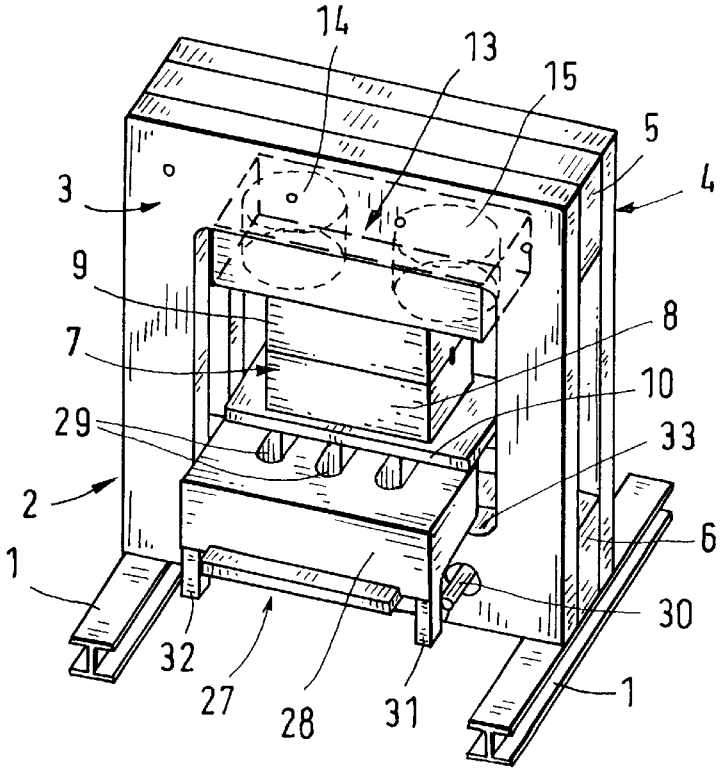
FIG. 2 is a perspective view of a second embodiment of the apparatus according to the present invention.

Equivalent components are provided with the same reference characters in FIGS. 1 and 2.

FIG. 1 of the drawing shows an apparatus for the hydraulic deformation of hollow bodies of metal. The apparatus includes a stationary press frame 2 mounted on bottom supports 1. The press frame 2 is formed by a front frame plate 3 and a rear frame plate 4 which are connected to each other through an upper crossbeam 5 and a lower crossbeam 6.

A shaping tool 7 is arranged in the press frame 2. The shaping tool 7 is composed of two parts, i.e., a lower part 8 and an upper part 9.

The lower part 8 is mounted so as to be guided vertically movable between an open position and a closed position. The closed position is shown in FIG. 1.

The lower part 8 is displaced by a lifting table 10 which is hydraulically moved upwardly and downwardly by a lifting cylinder 11. A guide rod 12 is provided for the lifting table 10.

The upper part 9 is movably braced indirectly against the press frame 2. For this purpose, the upper part 9 is attached to a hydraulic cushion 13. In the illustrated embodiment, the hydraulic cushion 13 is formed by the schematically indicated hydraulically acting piston/cylinder units 14, 15. The piston/cylinder units 14, 15 are secured with their cylinders at the upper part 9 and with their pistons at the upper crossbeam 5. The bottom side of the cylinders is constructed as a support plate.

After placing a hollow body to be shaped in the shaping tool, the lower part 8 is lifted by the lifting table 10 from the open position into the closed position. During this movement of the lower part 8, the hydraulic cushion 13 is without pressure.

After the lower part 8 reaches the closed position, the lower part 8 is locked by a locking member 16.

The locking member 16 is composed of a unit of two locking blocks 17 and 18 which are each mounted so as to be pivotable about a pivot bearing 23, 24 by means of a hydraulic cylinder 21, 22 acting against a lever arm 19, 20.

In the illustration of FIG. 1, the left locking block 17 as seen in the drawing is in the locking position underneath the lifting table 10, while the locking block 18 on the right is shown in the outwardly pivoted position.

After the shaping tool 7 has been closed, a pressure is applied to the hydraulic cushion 13. This causes the upper part 9 to be pressed hydraulically against the mechanically locked lower part 8. The stroke carried out by the upper part 9 is small. Subsequently, the internal high pressure process is carried out. During the shaping process, pressure is applied to the hydraulic cushion 13, so that the upper part 9 is automatically reset in the event of a possible longitudinal expansion of the side posts 25, 26 of the press frame 2. Consequently, the formation of a gap or a misalignment in the shaping tool 7 are prevented.

The shaping tool 7 is opened after the internal high pressure shaping process has been concluded. For this purpose, the locking member 16 releases the lifting table 10 by pivoting the locking blocks 17, 18 outwardly. Simultaneously, the pressure of the hydraulic cushion 13 is released. The lifting table 10 and the lower part 8 are lowered and the shaped product can be removed and conveyed to further processing.

The apparatus illustrated in FIG. 2 basically corresponds to that of FIG. 1. In contrast to the embodiment of FIG. 1, the embodiment of FIG. 2 is provided with a locking member 27 which is displaceable by a translatory movement, i.e., a movement along a straight line.

The locking member 27 is composed of a single-piece locking block 28 with recesses 29 for receiving the piston rod of the lifting cylinder 11 or the guide rods 12, which are visible in FIG. 1.

After the lower part 8 together with the lifting table 10 has reached the closed position, the locking member 27 is pushed on a horizontal guide track 33 underneath the lifting table 10 by means of hydraulic cylinders 30 which act against abutment arms 31, 32 of the locking block 28. This causes the lower part 8 to be locked and mechanically supported. The hydraulic support of the upper part 9 and the shaping process are carried out in the same manner as described above in connection with the embodiment of FIG. 1.

Figure 3:
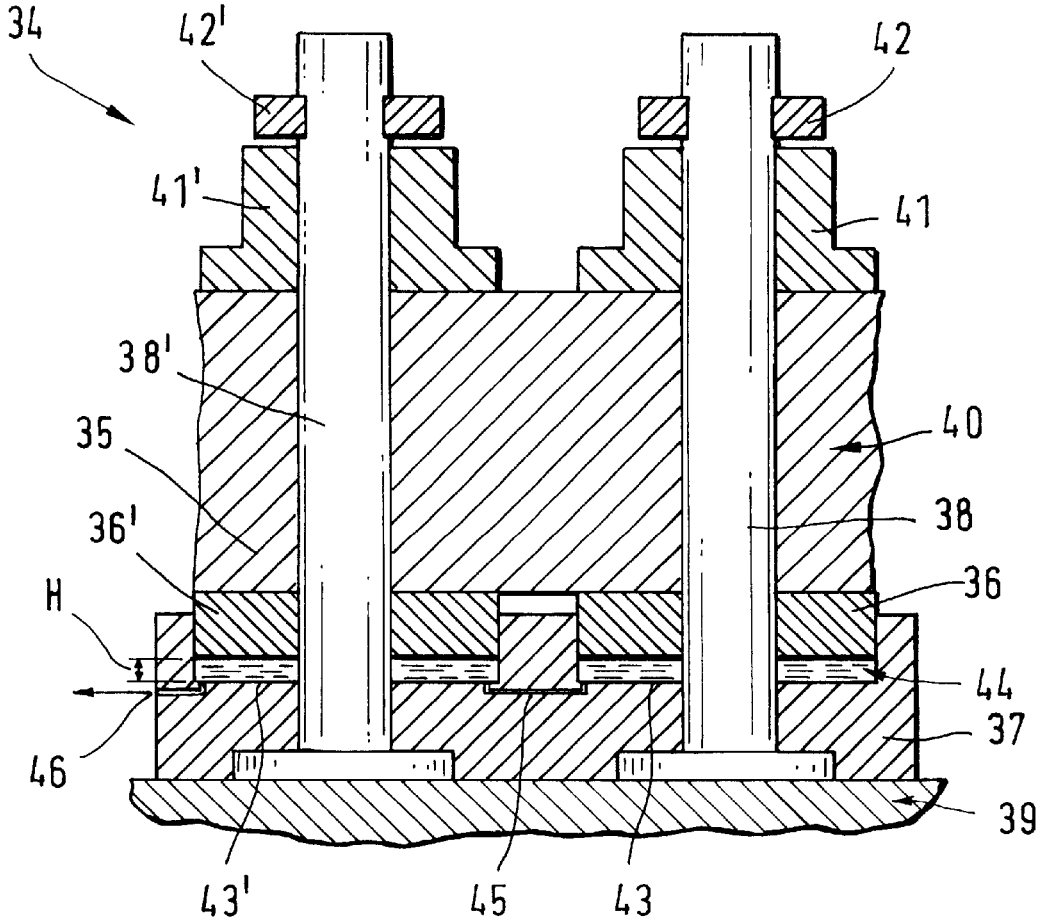
FIG. 3 is a partial sectional view, on a larger scale, showing a portion of a press frame with a hydraulic cushion.

FIG. 3 of the drawing shows in more detail the configuration of a hydraulic cushion 34.

The hydraulic cushion 34 includes a piston/cylinder unit 35 with two pistons 36, 36' and a common cylinder 37. The pistons 36, 36' and the cylinder 37 are guided at vertical columns 38, 38'. The cylinder 37 is secured at the upper part 39 of a tool, while the pistons 36, 36' rest against the upper crossbeam 40 of a press frame. At the upper side of the crossbeam 40, the columns 38, 38' are held in bearing components 41, 41'. Stroke limiting pieces 42, 42' are provided at the ends of the columns 38, 38'.

Hydraulic liquid 44 is present in the cylinder chambers 43, 43' formed between the pistons 36, 36' and the cylinder 37. The cylinder chambers 43, 43' are in communication with each other through a connecting bore 45. This ensures that a pressure equalization occurs. Reference number 46 denotes a connection to a control valve. The stroke of the hydraulic cushion 34 is indicated by the arrow H.

During the shaping process, pressure is applied to the hydraulic cushion 34. In the event of a possible longitudinal expansion of the side posts of the press frame, not shown in FIG. 3, the hydraulic cushion 34 ensures that the upper part 39 is automatically reset. Consequently, the formation of a gap or a misalignment in the shaping tool are avoided.

While specific embodiments of the invention have been described in detail to illustrate the inventive principles, it will be understood that the invention may be embodied otherwise without departing from such principles.

I claim:

1. An apparatus for hydraulically shaping hollow bodies of metal, the apparatus comprising a press frame and a shaping tool mounted in the press frame, the shaping tool comprising a lower part mounted so as to be vertically movable between an open position and a closed position, and an upper part movably braced against the press frame, further comprising a locking member for locking the lower part in the closed position, and hydraulic means for pressing the upper part against the lower part, further comprising a hydraulic cushion between the upper part and the press frame.

2. The apparatus according to claim 1, wherein the hydraulic cushion comprises at least one piston/cylinder unit.

3. The apparatus according to claim 1, wherein the locking body is mounted so as to be pivotable.

4. The apparatus according to claim 1, wherein the locking body is mounted so as to be displaceable by a translatory movement.

* * * * *